US012152605B2

(12) United States Patent
Fukami

(10) Patent No.: US 12,152,605 B2
(45) Date of Patent: Nov. 26, 2024

(54) VACUUM PUMP AND CONTROLLER

(71) Applicant: Edwards Japan Limited, Yachiyo (JP)

(72) Inventor: Hideo Fukami, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 16 days.

(21) Appl. No.: 18/001,558

(22) PCT Filed: Jul. 2, 2021

(86) PCT No.: PCT/JP2021/025220
§ 371 (c)(1),
(2) Date: Dec. 12, 2022

(87) PCT Pub. No.: WO2022/009812
PCT Pub. Date: Jan. 13, 2022

(65) Prior Publication Data

US 2023/0151826 A1 May 18, 2023

(30) Foreign Application Priority Data

Jul. 9, 2020 (JP) ..... 2020-118497

(51) Int. Cl.
*F04D 29/58* (2006.01)
*F04D 19/04* (2006.01)
*F04D 27/00* (2006.01)

(52) U.S. Cl.
CPC ..... *F04D 29/584* (2013.01); *F04D 19/042* (2013.01); *F04D 27/001* (2013.01)

(58) Field of Classification Search
CPC ..... F04D 19/04; F04D 19/042; F04D 29/584; F04D 27/00; F04D 27/001; F04D 27/006
See application file for complete search history.

(56) References Cited

U.S. PATENT DOCUMENTS 11,359,634 B2 6/2022 Fukami
2017/0306967 A1* 10/2017 Kozaki ..... F04D 27/001
(Continued)

FOREIGN PATENT DOCUMENTS

EP 3808985 A 4/2021
EP 4108929 A1 12/2022
(Continued)

OTHER PUBLICATIONS

International Search Report and Written Opinion of International Application No. PCT/JP2021/025220 dated Aug. 24, 2021, 9pp.
(Continued)

*Primary Examiner* — Kenneth J Hansen
(74) *Attorney, Agent, or Firm* — Shumaker & Sieffert, P.A.

(57) ABSTRACT

A vacuum pump and a controller are provided with which state information of the vacuum pump is collected in a timely manner. In a controller, control portions control operating states of internal devices (such as a motor, a heater, and a cooling valve) located in a vacuum pump main body. An information collection portion collects the state information of the vacuum pump main body, and a recording processing portion records, in the non-volatile memory, the state information collected by the information collection portion. Also, the information collection portion collects the state information of the vacuum pump main body at a point in time at which a control portion switches the operating state of an internal device.

5 Claims, 8 Drawing Sheets

(56) References Cited

U.S. PATENT DOCUMENTS

| | | | | |
|---|---|---|---|---|
| 2017/0371330 | A1 | 12/2017 | Kozaki | |
| 2017/0372000 | A1* | 12/2017 | Ethington | G06Q 10/20 |
| 2019/0107110 | A1* | 4/2019 | Kozaki | F04D 19/04 |
| 2020/0208628 | A1* | 7/2020 | Sigmar | F04C 11/008 |
| 2023/0057241 | A1 | 2/2023 | Fukami | |
| 2024/0077079 | A1* | 3/2024 | Maishigi | G06F 9/542 |

FOREIGN PATENT DOCUMENTS

| | | | |
|---|---|---|---|
| JP | 2001012379 | A | 1/2001 |
| JP | 2017194040 | A | 10/2017 |
| JP | 2018003615 | A | 1/2018 |
| WO | 2019239934 | A1 | 12/2019 |

OTHER PUBLICATIONS

Decision of Rejection, and translation thereof, from counterpart Japanese Application No. 2020-118497 dated Feb. 1, 2024, 10 pp.
Extended Search Report from counterpart European Application No. 21837477.5 dated Jun. 14, 2024, 10 pp.

* cited by examiner

VACUUM PUMP AND CONTROLLER

This application is a U.S. national phase application under 35 U.S.C. § 371 of international application number PCT/JP2021/025220 filed on Jul. 2, 2021, which claims the benefit of JP application number 2020-118497 filed on Jul. 9, 2020. The entire contents of each of international application number PCT/JP2021/025220 and JP application number 2020-118497 are incorporated herein by reference.

TECHNICAL FIELD

The present disclosure relates to a vacuum pump and a controller.

BACKGROUND

A monitoring device of a certain vacuum pump (a) determines whether the vacuum pump is in a gas inflow state, based on changes over time in the motor current value and the rotational speed of the vacuum pump, and (b) records, in a storage portion, a base temperature data set that is collected in a predetermined cycle in a period in which the vacuum pump is in the gas inflow state (see Japanese Patent Application Publication No. 2017-194040, for example).

SUMMARY

The vacuum pump state information collected as described above may be used for cause analysis, and the like, when a failure occurs in the vacuum pump.

In general, the state information is stored in a specific storage region in a non-volatile memory. However, of the state information data periodically obtained, only a predetermined number of the latest state information data pieces are held in the non-volatile memory. As such, only the state of the vacuum pump in a time period of a specific length (the product of the collection cycle and the above-mentioned predetermined number) can be ascertained from the state information data that is held. This may hinder an appropriate cause analysis. That is, when the collection cycle is too short relative to the period in which an event occurs due to a certain cause, only part of the event may be ascertained. When the collection cycle is too long relative to the period in which an event occurs due to a certain cause, the ascertaining of the occurrence of the event itself may be failed, or only a fragment of the event may be ascertained.

As such, vacuum pump state information may not be collected in a timely manner.

In view of the foregoing problems, it is an object of the present disclosure to provide a vacuum pump and a controller with which vacuum pump state information is collected in a timely manner.

A vacuum pump according to the present disclosure includes: an internal device located in a vacuum pump main body; a control portion configured to control an operating state of the internal device; an information collection portion configured to collect state information of the vacuum pump main body; and a recording processing portion configured to record, in a non-volatile memory, the state information collected by the information collection portion. The information collection portion collects the state information of the vacuum pump main body at a point in time at which the operating state of the internal device is switched by the control portion.

A controller according to the present disclosure includes: a control portion configured to control an operating state of an internal device located in a vacuum pump main body; an information collection portion configured to collect state information of the vacuum pump main body; and a recording processing portion configured to record, in a non-volatile memory, the state information collected by the information collection portion. The information collection portion collects the state information of the vacuum pump main body at a point in time at which the operating state of the internal device is switched by the control portion.

The present disclosure provides a vacuum pump and a controller with which vacuum pump state information is collected in a timely manner.

The above and other objects, features, and advantages of the present disclosure will become further apparent from the following detailed description together with the accompanying drawings.

DETAILED DESCRIPTION

Figure 1:
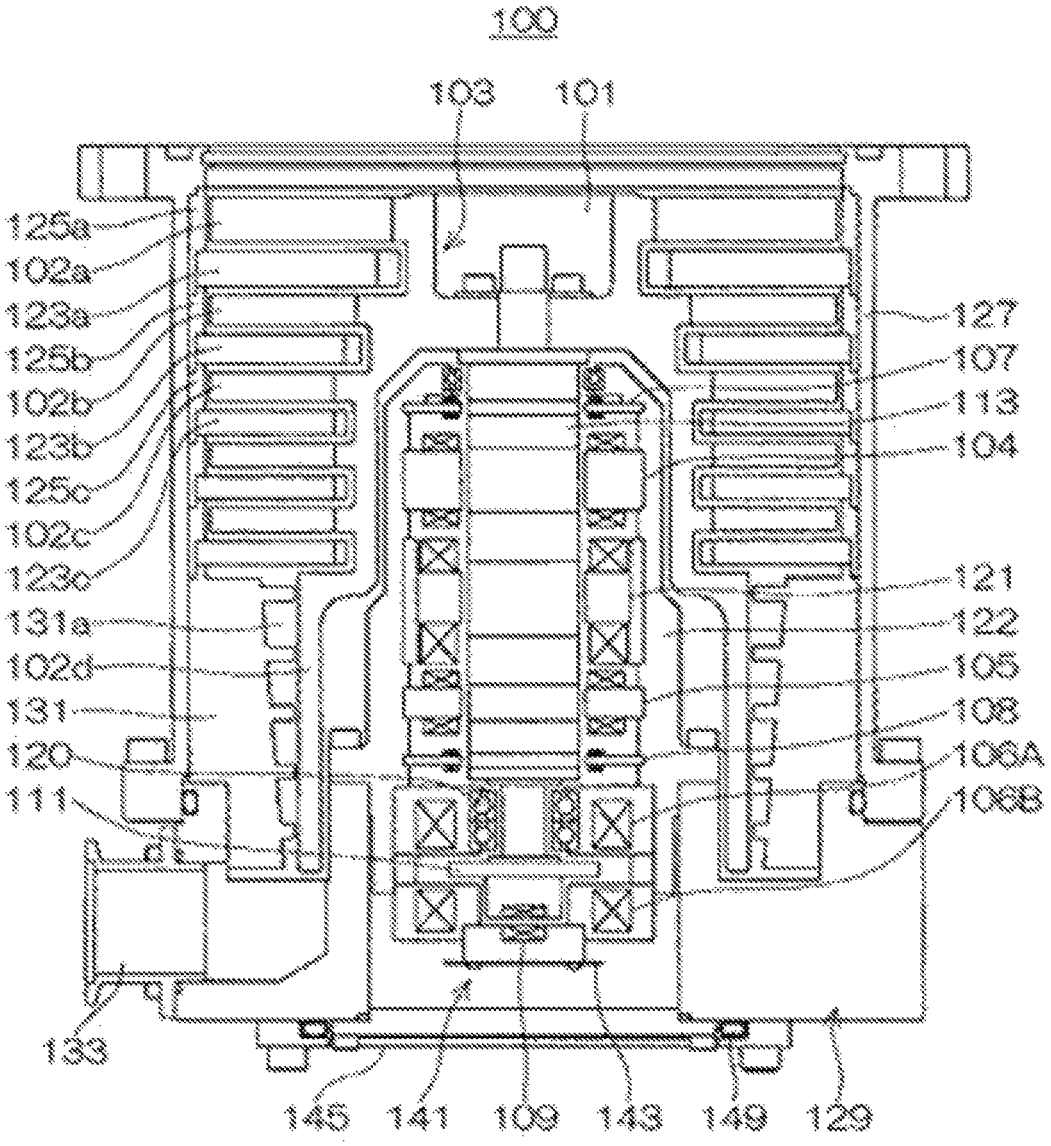
FIG. 1 is a vertical cross-sectional view of a turbomolecular pump according to an example of the present disclosure.

Referring to the drawings, an example of the present disclosure is now described.

FIG. 1 is vertical cross-sectional view of a turbomolecular pump 100. As shown in FIG. 1, the turbomolecular pump 100 includes a circular outer cylinder 127 having an inlet port 101 at its upper end. A rotating body 103 in the outer cylinder 127 includes a plurality of rotor blades 102 (102*a*, 102*b*, 102*c*, . . . ), which are turbine blades for gas suction and exhaustion, in its outer circumference section. The rotor blades 102 extend radially in multiple stages. The rotating body 103 has a rotor shaft 113 in its center. The rotor shaft 113 is suspended in the air and position-controlled by a magnetic bearing of 5-axis control, for example.

Upper radial electromagnets 104 include four electromagnets arranged in pairs on an X-axis and a Y-axis. Four upper radial sensors 107 are provided in close proximity to the upper radial electromagnets 104 and associated with the respective upper radial electromagnets 104. Each upper radial sensor 107 may be an inductance sensor or an eddy current sensor having a conduction winding, for example, and detects the position of the rotor shaft 113 based on a change in the inductance of the conduction winding, which changes according to the position of the rotor shaft 113. The upper radial sensors 107 are configured to detect a radial displacement of the rotor shaft 113, that is, the rotating body 103 fixed to the rotor shaft 113, and send it to the controller (not shown).

In the controller, for example, a compensation circuit having a PID adjustment function generates an excitation control command signal for the upper radial electromagnets 104 based on a position signal detected by the upper radial sensors 107. Based on this excitation control command signal, an amplifier circuit 150 (described below) controls and excites the upper radial electromagnets 104 to adjust a radial position of an upper part of the rotor shaft 113.

The rotor shaft 113 may be made of a high magnetic permeability material (such as iron and stainless steel) and is configured to be attracted by magnetic forces of the upper radial electromagnets 104. The adjustment is performed independently in the X-axis direction and the Y-axis direction. Lower radial electromagnets 105 and lower radial sensors 108 are arranged in a similar manner as the upper radial electromagnets 104 and the upper radial sensors 107 to adjust the radial position of the lower part of the rotor shaft 113 in a similar manner as the radial position of the upper part.

Additionally, axial electromagnets 106A and 106B are arranged so as to vertically sandwich a metal disc 111, which has a shape of a circular disc and is provided in the lower part of the rotor shaft 113. The metal disc 111 is made of a high magnetic permeability material such as iron. An axial sensor 109 is provided to detect an axial displacement of the rotor shaft 113 and send an axial position signal to the controller.

In the controller, the compensation circuit having the PID adjustment function may generate an excitation control command signal for each of the axial electromagnets 106A and 106B based on the signal on the axial position detected by the axial sensor 109. Based on these excitation control command signals, the amplifier circuit 150 controls and excites the axial electromagnets 106A and 106B separately so that the axial electromagnet 106A magnetically attracts the metal disc 111 upward and the axial electromagnet 106B attracts the metal disc 111 downward. The axial position of the rotor shaft 113 is thus adjusted.

As described above, the controller appropriately adjusts the magnetic forces exerted by the axial electromagnets 106A and 106B on the metal disc 111, magnetically levitates the rotor shaft 113 in the axial direction, and suspends the rotor shaft 113 in the air in a non-contact manner. The amplifier circuit 150, which controls and excites the upper radial electromagnets 104, the lower radial electromagnets 105, and the axial electromagnets 106A and 106B, is described below.

The motor 121 includes a plurality of magnetic poles circumferentially arranged to surround the rotor shaft 113. Each magnetic pole is controlled by the controller so as to drive and rotate the rotor shaft 113 via an electromagnetic force acting between the magnetic pole and the rotor shaft 113. The motor 121 also includes a rotational speed sensor (not shown), such as a Hall element, a resolver, or an encoder, and the rotational speed of the rotor shaft 113 is detected based on a detection signal of the rotational speed sensor.

Furthermore, a phase sensor (not shown) is attached adjacent to the lower radial sensors 108 to detect the phase of rotation of the rotor shaft 113. The controller detects the position of the magnetic poles using both detection signals of the phase sensor and the rotational speed sensor.

A plurality of stator blades 123*a*, 123*b*, 123*c*, . . . are arranged slightly spaced apart from the rotor blades 102 (102*a*, 102*b*, 102*c*, . . . ). Each rotor blade 102 (102*a*, 102*b*, 102*c*, . . . ) is inclined by a predetermined angle from a plane perpendicular to the axis of the rotor shaft 113 in order to transfer exhaust gas molecules downward through collision.

The stator blades 123 are also inclined by a predetermined angle from a plane perpendicular to the axis of the rotor shaft 113. The stator blades 123 extend inward of the outer cylinder 127 and alternate with the stages of the rotor blades 102. The outer circumference ends of the stator blades 123 are inserted between and thus supported by a plurality of layered stator blade spacers 125 (125*a*, 125*b*, 125*c*, . . . ).

The stator blade spacers 125 are ring-shaped members made of a metal, such as aluminum, iron, stainless steel, or copper, or an alloy containing these metals as components, for example. The outer cylinder 127 is fixed to the outer circumferences of the stator blade spacers 125 with a slight gap. A base portion 129 is located at the base of the outer cylinder 127. The base portion 129 has an outlet port 133 providing communication to the outside. The exhaust gas transferred to the base portion 129 is then sent to the outlet port 133.

According to the application of the turbomolecular pump 100, a threaded spacer 131 may be provided between the lower part of the stator blade spacer 125 and the base portion 129. The threaded spacer 131 is a cylindrical member made of a metal such as aluminum, copper, stainless steel, or iron, or an alloy containing these metals as components. The threaded spacer 131 has a plurality of helical thread grooves 131*a* in its inner circumference surface. When exhaust gas molecules move in the rotation direction of the rotating body 103, these molecules are transferred toward the outlet port 133 in the direction of the helix of the thread grooves 131*a*. In the lowermost section of the rotating body 103 below the rotor blades 102 (102*a*, 102*b*, 102*c*, . . . ), a cylindrical portion 102*d* extends downward. The outer circumference surface of the cylindrical portion 102*d* is cylindrical and projects toward the inner circumference surface of the threaded spacer 131. The outer circumference surface is adjacent to but separated from the inner circumference surface of the threaded spacer 131 by a predetermined gap. The exhaust gas transferred to the thread grooves 131*a* by the rotor blades 102 and the stator blades 123 is guided by the thread grooves 131*a* to the base portion 129.

The base portion 129 is a disc-shaped member forming the base section of the turbomolecular pump 100, and is generally made of a metal such as iron, aluminum, or stainless steel. The base portion 129 physically holds the turbomolecular pump 100 and also serves as a heat conduction path. As such, the base portion 129 is preferably made of rigid metal with high thermal conductivity, such as iron, aluminum, or copper.

In this configuration, when the motor 121 drives and rotates the rotor blades 102 together with the rotor shaft 113, the interaction between the rotor blades 102 and the stator blades 123 causes the suction of exhaust gas from the chamber through the inlet port 101. The exhaust gas taken through the inlet port 101 moves between the rotor blades 102 and the stator blades 123 and is transferred to the base portion 129. At this time, factors such as the friction heat generated when the exhaust gas comes into contact with the rotor blades 102 and the conduction of heat generated by the motor 121 increase the temperature of the rotor blades 102. This heat is conducted to the stator blades 123 through radiation or conduction via gas molecules of the exhaust gas, for example.

The stator blade spacers 125 are joined to each other at the outer circumference portion and conduct the heat received by the stator blades 123 from the rotor blades 102, the friction heat generated when the exhaust gas comes into contact with the stator blades 123, and the like to the outside.

In the above description, the threaded spacer 131 is provided at the outer circumference of the cylindrical portion 102*d* of the rotating body 103, and the thread grooves 131*a* are engraved in the inner circumference surface of the threaded spacer 131. However, this may be inversed in some cases, and a thread groove may be engraved in the outer circumference surface of the cylindrical portion 102*d*, while a spacer having a cylindrical inner circumference surface may be arranged around the outer circumference surface.

According to the application of the turbomolecular pump 100, to prevent the gas drawn through the inlet port 101 from entering an electrical portion, which includes the upper radial electromagnets 104, the upper radial sensors 107, the motor 121, the lower radial electromagnets 105, the lower radial sensors 108, the axial electromagnets 106A, 106B, and the axial sensor 109, the electrical portion may be surrounded by a stator column 122. The inside of the stator column 122 may be maintained at a predetermined pressure by purge gas.

In this case, the base portion 129 has a pipe (not shown) through which the purge gas is introduced. The introduced purge gas is sent to the outlet port 133 through gaps between a protective bearing 120 and the rotor shaft 113, between the rotor and the stator of the motor 121, and between the stator column 122 and the inner circumference cylindrical portion of the rotor blade 102.

The turbomolecular pump 100 may use the identification of the model and control based on individually adjusted unique parameters (for example, various characteristics associated with the model). To store these control parameters, the turbomolecular pump 100 includes an electronic circuit portion 141 in its main body. The electronic circuit portion 141 may include a semiconductor memory, such as an EEPROM, electronic components such as semiconductor elements for accessing the semiconductor memory, and a substrate 143 for mounting these components. The electronic circuit portion 141 is housed under a rotational speed sensor (not shown) near the center, for example, of the base portion 129, which forms the lower part of the turbomolecular pump 100, and is closed by an airtight bottom lid 145.

Some process gas introduced into the chamber in the manufacturing process of semiconductors has the property of becoming solid when its pressure becomes higher than a predetermined value or its temperature becomes lower than a predetermined value. In the turbomolecular pump 100, the pressure of the exhaust gas is lowest at the inlet port 101 and highest at the outlet port 133. When the pressure of the process gas increases beyond a predetermined value or its temperature decreases below a predetermined value while the process gas is being transferred from the inlet port 101 to the outlet port 133, the process gas is solidified and adheres and accumulates on the inner side of the turbomolecular pump 100.

For example, when $SiCl_4$ is used as the process gas in an Al etching apparatus, according to the vapor pressure curve, a solid product (for example, $AlCl_3$) is deposited at a low vacuum (760 [torr] to $10^{-2}$ [torr]) and a low temperature (about 20 [° C.]) and adheres and accumulates on the inner side of the turbomolecular pump 100. When the deposit of the process gas accumulates in the turbomolecular pump 100, the accumulation may narrow the pump flow passage and degrade the performance of the turbomolecular pump 100. The above-mentioned product tends to solidify and adhere in areas with higher pressures, such as the vicinity of the outlet port and the vicinity of the threaded spacer 131.

To solve this problem, conventionally, a heater or annular water-cooled tube 149 (not shown) is wound around the outer circumference of the base portion 129, and a temperature sensor (e.g., a thermistor, not shown) is embedded in the base portion 129, for example. The signal of this temperature sensor is used to perform control to maintain the temperature of the base portion 129 at a constant high temperature (preset temperature) by heating with the heater or cooling with the water-cooled tube 149 (hereinafter referred to as TMS (temperature management system)).

Figure 2:
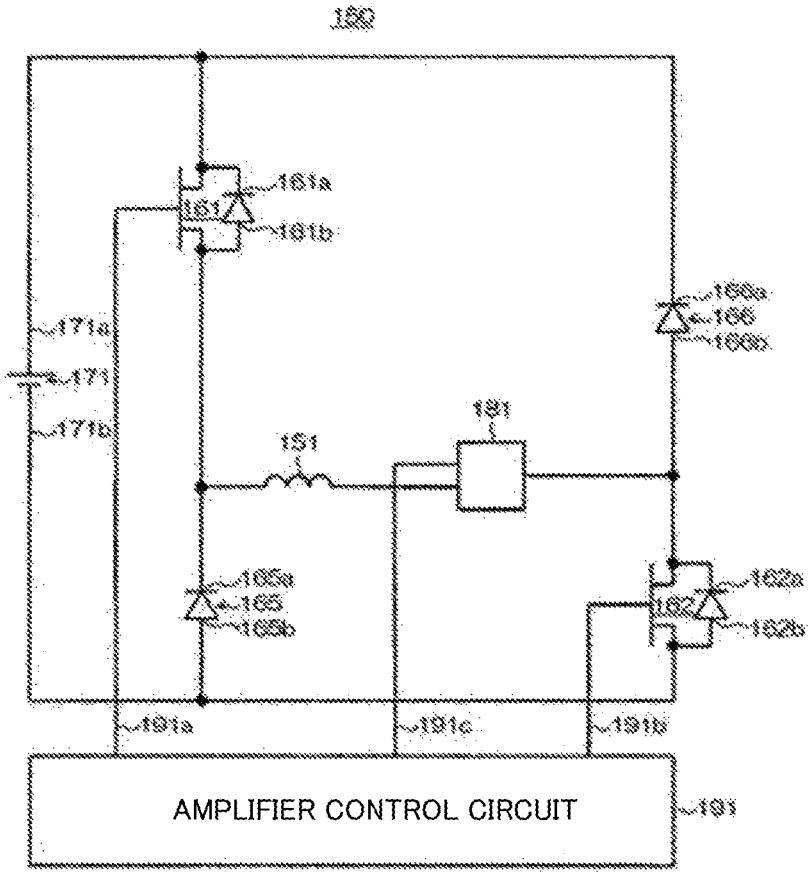
FIG. 2 is a circuit diagram of an amplifier circuit.

The amplifier circuit 150 is now described that controls and excites the upper radial electromagnets 104, the lower radial electromagnets 105, and the axial electromagnets 106A and 106B of the turbomolecular pump 100 configured as described above. FIG. 2 is a circuit diagram of the amplifier circuit.

In FIG. 2, one end of an electromagnet winding 151 forming an upper radial electromagnet 104 or the like is connected to a positive electrode 171*a* of a power supply 171 via a transistor 161, and the other end is connected to a negative electrode 171*b* of the power supply 171 via a current detection circuit 181 and a transistor 162. Each transistor 161, 162 is a power MOSFET and has a structure in which a diode is connected between the source and the drain thereof.

In the transistor 161, a cathode terminal 161*a* of its diode is connected to the positive electrode 171*a*, and an anode terminal 161*b* is connected to one end of the electromagnet winding 151. In the transistor 162, a cathode terminal 162*a* of its diode is connected to a current detection circuit 181, and an anode terminal 162*b* is connected to the negative electrode 171*b*.

A diode 165 for current regeneration has a cathode terminal 165*a* connected to one end of the electromagnet winding 151 and an anode terminal 165*b* connected to the negative electrode 171*b*. Similarly, a diode 166 for current regeneration has a cathode terminal 166*a* connected to the positive electrode 171*a* and an anode terminal 166*b* connected to the other end of the electromagnet winding 151 via the current detection circuit 181. The current detection circuit 181 may include a Hall current sensor or an electric resistance element, for example.

The amplifier circuit 150 configured as described above corresponds to one electromagnet. Accordingly, when the magnetic bearing uses 5-axis control and has ten electromagnets 104, 105, 106A, and 106B in total, an identical amplifier circuit 150 is configured for each of the electromagnets. These ten amplifier circuits 150 are connected to the power supply 171 in parallel.

An amplifier control circuit 191 may be formed by a digital signal processor portion (not shown, hereinafter referred to as a DSP portion) of the controller. The amplifier control circuit 191 switches the transistors 161 and 162 between on and off.

The amplifier control circuit 191 is configured to compare a current value detected by the current detection circuit 181 (a signal reflecting this current value is referred to as a current detection signal 191*c*) with a predetermined current command value. The result of this comparison is used to determine the magnitude of the pulse width (pulse width time Tp1, Tp2) generated in a control cycle Ts, which is one cycle in PWM control. As a result, gate drive signals 191*a* and 191*b* having this pulse width are output from the amplifier control circuit 191 to gate terminals of the transistors 161 and 162.

Under certain circumstances such as when the rotational speed of the rotating body 103 reaches a resonance point during acceleration, or when a disturbance occurs during a constant speed operation, the rotating body 103 may benefit from positional control at high speed and with a strong force. For this purpose, a high voltage of about 50 V, for example, is used for the power supply 171 to enable a rapid increase (or decrease) in the current flowing through the electromagnet winding 151. Additionally, a capacitor is generally connected between the positive electrode 171*a* and the negative electrode 171*b* of the power supply 171 to stabilize the power supply 171 (not shown).

In this configuration, when both transistors 161 and 162 are turned on, the current flowing through the electromagnet winding 151 (hereinafter referred to as an electromagnet current iL) increases, and when both are turned off, the electromagnet current iL decreases.

Also, when one of the transistors 161 and 162 is turned on and the other is turned off, a freewheeling current is maintained. Passing the freewheeling current through the amplifier circuit 150 in this manner reduces the hysteresis loss in the amplifier circuit 150, thereby limiting the power consumption of the entire circuit to a low level. Moreover, by controlling the transistors 161 and 162 as described above, high frequency noise, such as harmonics, generated in the turbomolecular pump 100 can be reduced. Furthermore, by measuring this freewheeling current with the current detection circuit 181, the electromagnet current iL flowing through the electromagnet winding 151 can be detected.

Figure 3:
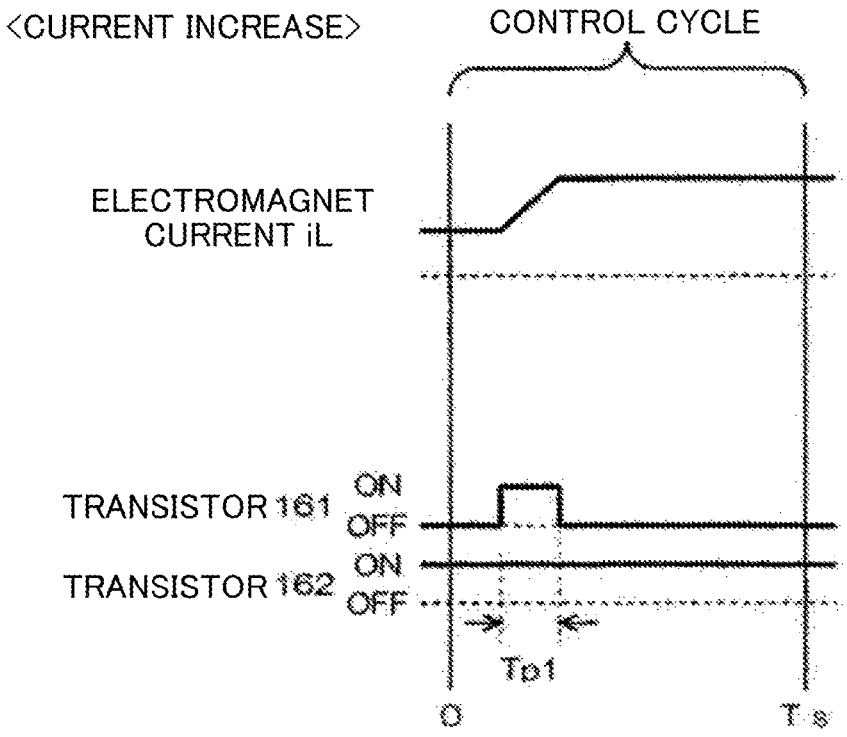
FIG. 3 is a time chart showing control performed when a current command value is greater than a detected value.

That is, when the detected current value is smaller than the current command value, as shown in FIG. 3, the transistors 161 and 162 are simultaneously on only once in the control cycle Ts (for example, 100 μs) for the time corresponding to the pulse width time Tp1. During this time, the electromagnet current iL increases accordingly toward the current value iLmax (not shown) that can be passed from the positive electrode 171*a* to the negative electrode 171*b* via the transistors 161 and 162.

Figure 4:
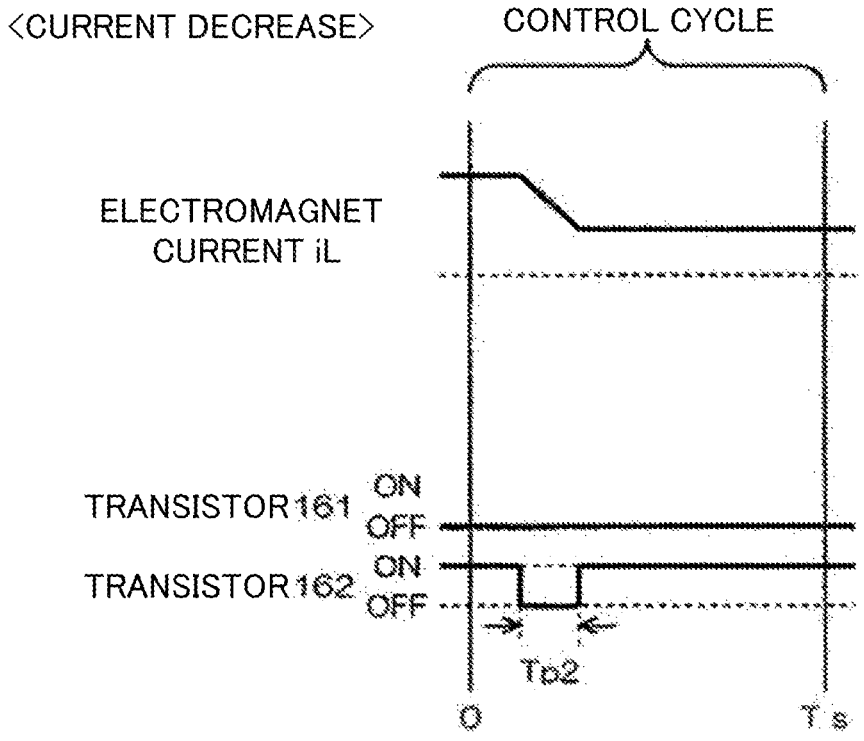
FIG. 4 is a time chart showing control performed when a current command value is less than a detected value.

When the detected current value is larger than the current command value, as shown in FIG. 4, the transistors 161 and 162 are simultaneously off only once in the control cycle Ts for the time corresponding to the pulse width time Tp2. During this time, the electromagnet current iL decreases accordingly toward the current value iLmin (not shown) that can be regenerated from the negative electrode 171*b* to the positive electrode 171*a* via the diodes 165 and 166.

In either case, after the pulse width time Tp1, Tp2 has elapsed, one of the transistors 161 and 162 is on. During this period, the freewheeling current is thus maintained in the amplifier circuit 150.

Figure 5:
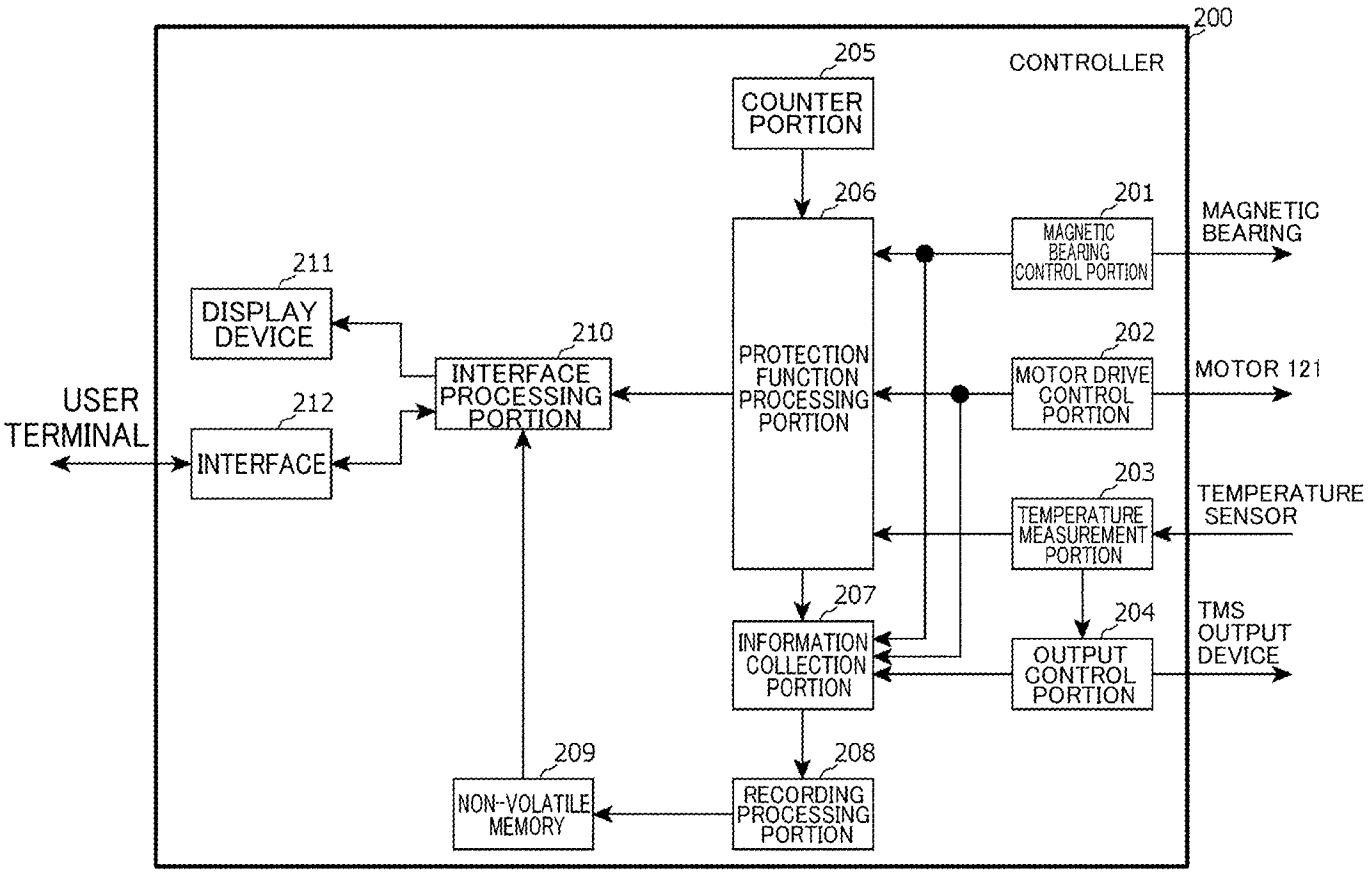
FIG. 5 is a block diagram showing the configuration of a controller that controls the turbomolecular pump (vacuum pump) shown in FIG. 1.

The turbomolecular pump 100 described above is an example of a vacuum pump. The controller described above has functions described below. FIG. 5 is a block diagram showing the configuration of a controller 200 that controls the turbomolecular pump (vacuum pump) shown in FIG. 1.

The controller 200 shown in FIG. 5 includes a magnetic bearing control portion 201, a motor drive control portion 202, a temperature measurement portion 203, an output control portion 204, a counter portion 205, a protection function processing portion 206, an information collection portion 207, a recording processing portion 208, a non-volatile memory 209, an interface processing portion 210, a display device 211, and an interface 212.

The magnetic bearing control portion 201 electrically controls the operating state of the magnetic bearing of the rotor shaft 113 (the upper radial electromagnets 104, the lower radial electromagnets 105, the axial electromagnets 106A and 106B, the upper radial sensors 107, the lower radial sensors 108, and the axial sensor 109) to adjust the radial and axial position of the rotor shaft 113 as described above.

The motor drive control portion 202 electrically controls the operating state of the motor 121 and rotates the motor 121 at a predetermined rotational speed.

The temperature measurement portion 203 is a temperature sensor for the TMS described above and measures the temperature of the location where the temperature sensor is arranged. Specifically, the temperature measurement portion 203 identifies the temperature of that location based on the output signal of the temperature sensor.

The output control portion 204 electrically controls the operating states of output devices for the TMS, such as the above-mentioned heater and a valve of the water-cooled tube 149 (cooling valve). The heater is turned on/off, and the cooling valve is opened/closed such that the temperature at the location where the temperature sensor is located is a predetermined temperature.

The counter portion 205 counts the time elapsed since activating the vacuum pump or the actual time. The counter portion 205 may be a timer that counts up the elapsed time, a real-time clock, or the like.

The protection function processing portion 206 obtains state information of the vacuum pump from the magnetic bearing control portion 201, the motor drive control portion 202, the temperature measurement portion 203, and the like. In case of an abnormality of the vacuum pump, the protection function processing portion 206 detects the abnormality based on the state information.

The state information includes the heater temperature, the cooling temperature, the temperatures of different portions such as rotor blades, the rotational speed (number of revolutions) of the motor 121, heater on/off state, cooling valve open/closed state, and the like.

The information collection portion 207 collects, from the protection function processing portion 206, state information of specific points in time from the state information of the vacuum pump main body obtained by the protection function processing portion 206.

Specifically, the information collection portion 207 collects the state information of the vacuum pump main body at the point in time when a control portion (such as the output control portion 204 or the motor drive control portion 202) that controls the operating state of an internal device (such as the TMS output device or the motor 121) located in the vacuum pump main body switches the operating state of the internal device.

Thus, in this example, the internal device includes a temperature management device (i.e., the TMS output device described above), and the temperature management device includes at least one of a heater and a cooling valve. Also, in this example, the internal device includes a power system device, and the power system device includes at least one of the motor 121 and a magnetic bearing.

In particular, the information collection portion 207 of the present example collects the state information of the vacuum pump main body at activation of the vacuum pump as the initial values of the state information. Specifically, a self-diagnostic process is performed immediately after the vacuum pump is activated, and the information collection portion 207 collects the state information of the vacuum pump main body at the time of performing the self-diagnostic process as the initial values of the state information. This allows the number of power-on times (that is, the number of activation times) to be identified from the state information recorded in the non-volatile memory 209.

Additionally, the information collection portion 207 of the present example monitors, from activation of the vacuum pump, whether the operating state of an internal device is switched by a control portion and, instead of periodically collecting the state information of the vacuum pump main body, collects the state information of the vacuum pump main body at the point in time when the operating state of an internal device is switched by a control portion.

The recording processing portion 208 records the state information collected by the information collection portion 207 in a built-in non-volatile memory 209. At this time, time information indicating the point in time when the state information is collected is recorded together with the state information. The time information is obtained by the counter portion 205. The non-volatile memory 209 may be a flash memory or other non-volatile memory. Specifically, the recording processing portion 208 (a) records the state information in a storage region of a predetermined size in the non-volatile memory 209, and (b) uses the storage region as a ring buffer to record the state information. That is, the state information of one point in time is stored as one data set in one buffer region of a predetermined number of buffer regions in the ring buffer. After all of the predetermined number of buffer regions store state information data sets, the oldest state information data set is overwritten with the latest state information data set.

The interface processing portion 210 displays the state information of the vacuum pump main body obtained by the protection function processing portion 206 on the display device 211, reads out the state information stored in the non-volatile memory 209, and outputs it to the outside through the interface 212.

The display device 211 includes an indicator such as an LED, a liquid crystal display, and the like, and displays various types of information to the user. The interface 212 performs data communication with an external terminal device through serial communication or the like according to a predetermined communication standard.

The operation of the vacuum pump is now described.

Figure 6:
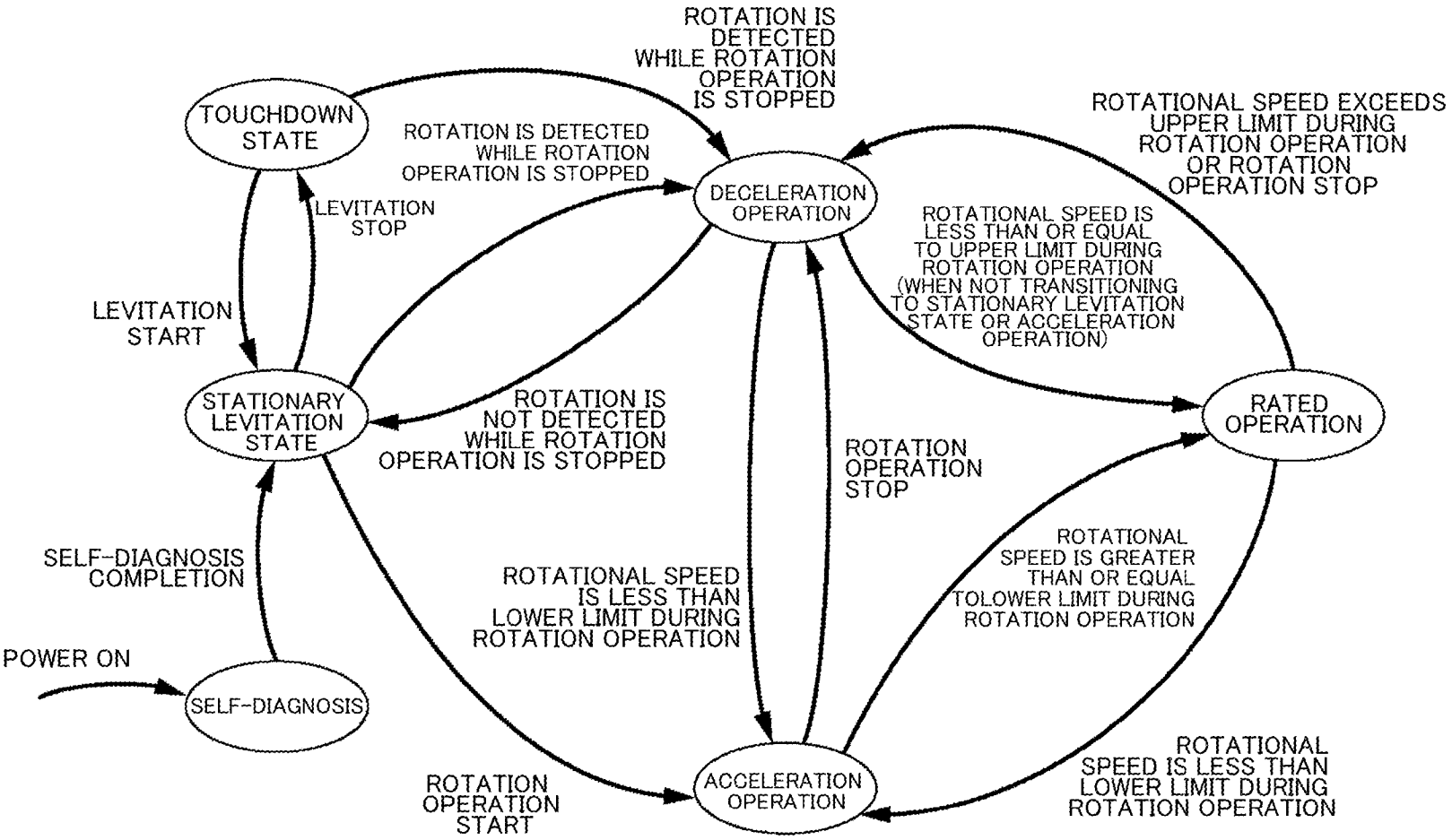
FIG. 6 is a diagram illustrating an example of state transition of the turbomolecular pump (vacuum pump) shown in FIG. 1.

FIG. 6 is a diagram illustrating an example of state transition of the turbomolecular pump (vacuum pump) shown in FIG. 1. For example, as shown in FIG. 6, when the power is turned on, the controller 200 performs a predetermined self-diagnostic process. When the self-diagnostic process is completed, the magnetic bearing control portion 201 controls the magnetic bearing to place the vacuum pump in a stationary levitation state. Subsequently, when the operation of the vacuum pump is started, the motor drive control portion 202 starts controlling the motor 121 to accelerate the motor 121, thereby bringing the vacuum pump into an acceleration operating state. When the rotational speed of the vacuum pump reaches a permissible range, the motor drive control portion 202 places the vacuum pump into a rated operating state. Then, the motor drive control portion 202 appropriately places the vacuum pump into an acceleration operating state or a deceleration operating state so that the rotational speed of the vacuum pump is within the permissible range (that is, the rated operating state is maintained). At the end of the operation, the motor drive control portion 202 places the vacuum pump into a deceleration operating state, and when the rotation of the motor 121 is no longer detected, the vacuum pump transitions to a stationary levitation state. Also, when the rotation of the motor is detected while the vacuum pump is not operating, the motor drive control portion 202 places the vacuum pump into a deceleration operating state, and when the rotation of the motor 121 is no longer detected, the vacuum pump transitions to a stationary levitation state.

In this manner, when the vacuum pump is in operation, control is performed to switch the operating state of the motor 121 to maintain the rated operating state. Additionally, the amount of heat generated by the motor 121 changes with the load of the motor 121 and the flow rate of the gas, for example, and the environmental temperature also changes. As such, the temperature management of the gas flow passage is dynamically performed by the TMS described above.

The protection function processing portion 206 periodically obtains state information from the magnetic bearing control portion 201, the motor drive control portion 202, the temperature measurement portion 203, and the like, and monitors whether an abnormality has occurred in the vacuum pump.

Figure 7:
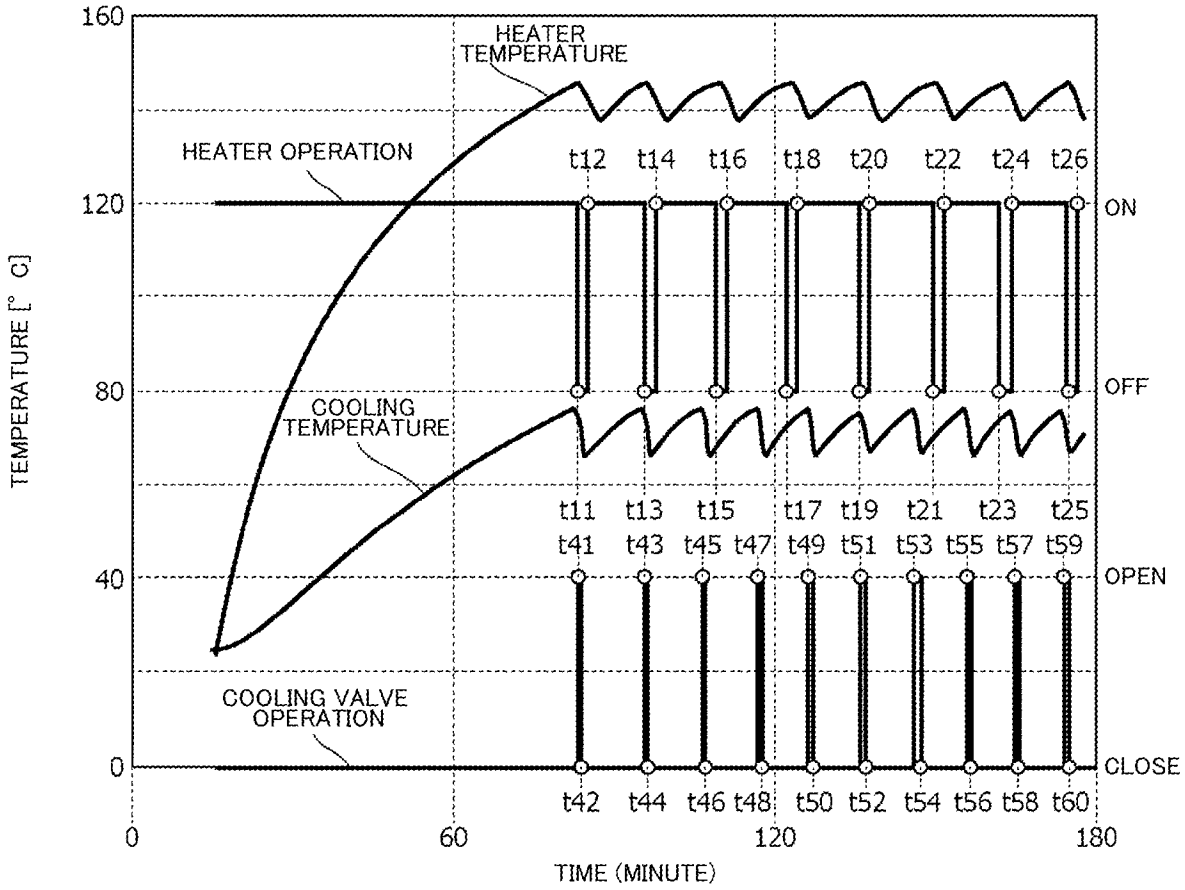
FIG. 7 is a diagram illustrating the information collection timing of the controller shown in FIG. 5 (1/2).
Figure 8:
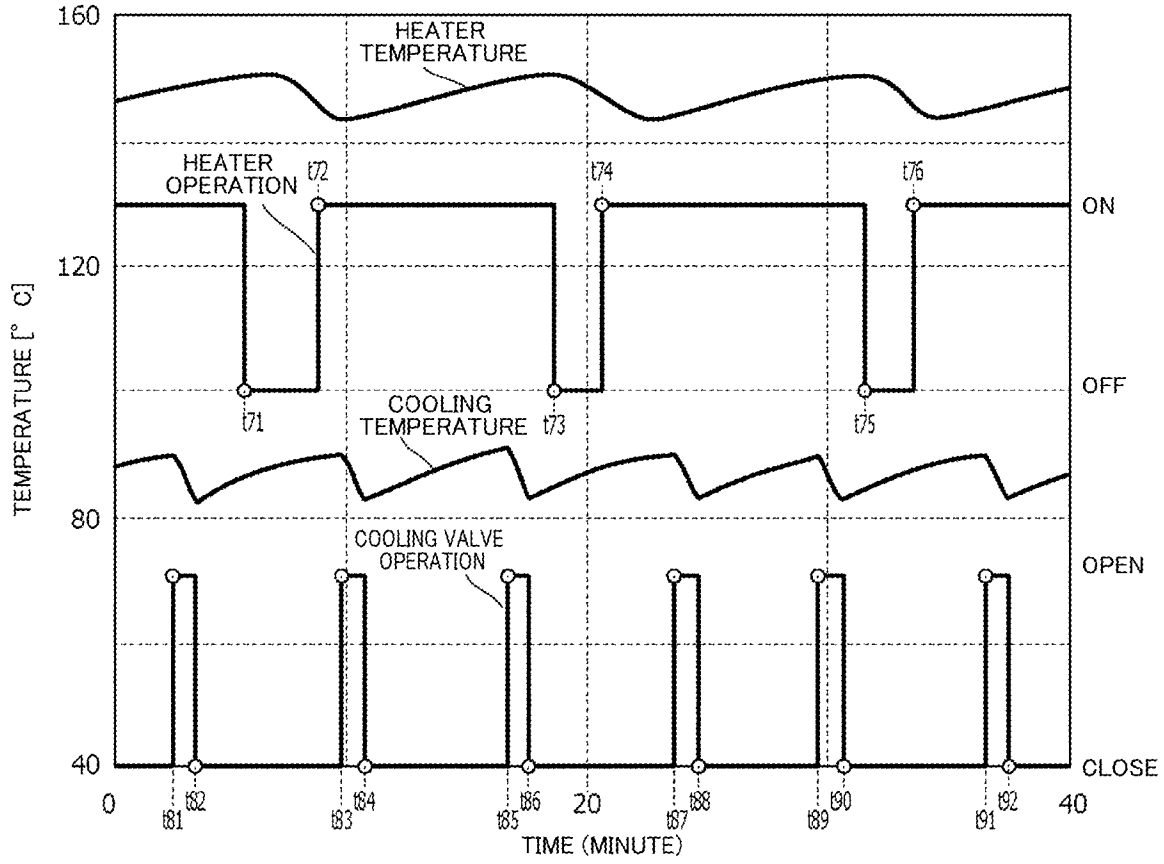
FIG. 8 is a diagram illustrating the information collection timing of the controller shown in FIG. 5 (2/2).

The information collection portion 207 detects a point in time when the control of the magnetic bearing control portion 201, the motor drive control portion 202, the output control portion 204, or the like is switched. Upon detecting a switching time point, the information collection portion 207 collects the state information of specific items together with the time information indicating the switching time point from the protection function processing portion 206 and records the information in the non-volatile memory 209 using the recording processing portion 208. The time information is provided by the counter portion FIGS. 7 and 8 are diagrams illustrating the information collection timing of the controller shown in FIG. 5. FIG. 7 is a diagram illustrating the information collection timing at activation of the vacuum pump. FIG. 8 is a diagram illustrating the information collection timing during operation of the vacuum pump.

For example, as shown in FIG. 7, after the vacuum pump is activated, the output control portion 204 turns on the heater and closes the cooling valve. This increases the heater temperature (the detected value of the temperature sensor corresponding to the heater) and the cooling temperature (the detected value of the temperature sensor corresponding to the cooling valve).

The output control portion 204 turns off the heater when the heater temperature exceeds a predetermined target temperature, and then turns on the heater when the heater temperature falls below the predetermined target temperature. The output control portion 204 thus controls the heater so that the heater temperature is maintained at the predetermined target temperature. In FIG. 7, at points in time t11, t13, t15, t17, t19, t21, t23, and t25, the operating state of the heater is switched from the ON state to the OFF state, and at points in time t12, t14, t16, t18, t20, t22, t24, and t26, the operating state of the heater is switched from the OFF state to the ON state.

The output control portion 204 opens the cooling valve when the cooling temperature exceeds a predetermined target temperature, and then closes the cooling valve when the cooling temperature falls below the predetermined target temperature. The output control portion 204 thus controls the cooling valve so that the cooling temperature is maintained at the predetermined target temperature. In FIG. 7, at points in time t41, t43, t45, t47, t49, t51, t53, t55, t57, and t59, the operating state of the cooling valve is switched from the closed state to the open state, and at points in time t42, t44, t46, t48, t50, t52, t54, t56, t58, and t60, the operating state of the cooling valve is switched from the open state to the closed state.

The information collection portion 207 monitors, from activation of the vacuum pump, whether the operating state of the TMS output device or a power system device, such as the motor 121, is switched and, instead of periodically collecting the state information of the vacuum pump main body, collects the state information of the vacuum pump main body at the point in time when the operating state of an internal device is switched. The information collection portion 207 records this information in the non-volatile memory 209 using the recording processing portion 208.

Accordingly, in the example shown in FIG. 7, the information collection portion 207 collects the state information of the vacuum pump main body at points in time t11 to t26 and t41 to t60 and records the information in the non-volatile memory 209 using the recording processing portion 208. For example, as shown in FIG. 7, state information is not recorded in the non-volatile memory 209 before the heater temperature or the cooling temperature reaches the target temperature after activation.

After the control of the motor 121 starts, the state information of the vacuum pump main body is collected at the point in time when the motor operating state is switched between acceleration operation, rated operation, and deceleration operation. The state information is recorded by the recording processing portion 208 in the non-volatile memory 209.

As such, in the example shown in FIG. 8, in addition to points in time t71 to t76 at which the heater operating state is switched and points in time t81 to t92 at which the cooling valve operating state is switched, the information collection portion 207 also collects the state information of the vacuum pump main body at the point in time when the motor operating state is switched, and records the information in the non-volatile memory 209 using the recording processing portion 208. Similarly, the state information is collected and recorded when the operating state of the magnetic bearing is switched between the stationary levitation state and the touchdown state.

The state information stored in the non-volatile memory 209 in this manner is read out to an external device via the interface 212 and the interface processing portion 210, and is used to analyze the cause of a failure of the vacuum pump, for example.

As described above, according to the above example, the control portions 201, 202, and 204 control the operating states of internal devices (such as the motor 121, heater, and cooling valve) located in the vacuum pump main body. The information collection portion 207 collects the state information of the vacuum pump main body, and the recording processing portion 208 records the state information collected by the information collection portion 207 in the non-volatile memory 209. Also, the information collection portion 207 collects the state information of the vacuum pump main body at the point in time when the control portion 201, 202, 204 switches the operating state of an internal device.

Accordingly, the state information of the vacuum pump is collected in a timely manner. As a result, even when the storage region for the state information in the non-volatile memory 209 is not large, the analysis of the cause of failure is likely to be smoothly performed.

Various alterations and modifications to the above-described examples will be apparent to those skilled in the art. Such alterations and modifications may be made without departing from the spirit and scope of the subject matter and without compromising the intended advantages. That is, such alterations and modifications are intended to be within the scope of the claims.

For example, in the above example, the information collection portion 207 collects all the state information of a plurality of specific items in response to switching of the operating state of any one of a plurality of internal devices. Alternatively, in response to switching of the operating state of any one of the internal devices, the state information of only some of the specific items corresponding to the internal device whose operating state has been switched may be collected.

Furthermore, in the example described above, when an information collection time point (switching of the operating state of an internal device) is detected within a predetermined time after state information is recorded in the non-volatile memory 209, the state information does not have to be recorded in the non-volatile memory 209.

The present is applicable to vacuum pumps, for example.

FIG. 2

191 AMPLIFIER CONTROL CIRCUIT

FIG. 3

<CURRENT INCREASE>

CONTROL CYCLE

ELECTROMAGNET CURRENT iL

TRANSISTOR

FIG. 4

<CURRENT DECREASE>

CONTROL CYCLE

ELECTROMAGNET CURRENT iL

TRANSISTOR

FIG. 5

USER TERMINAL

211 DISPLAY DEVICE

212 INTERFACE

210 INTERFACE PROCESSING PORTION

209 NON-VOLATILE MEMORY

205 COUNTER PORTION

206 PROTECTION FUNCTION PROCESSING PORTION

207 INFORMATION COLLECTION PORTION

208 RECORDING PROCESSING PORTION

200 CONTROLLER

201 MAGNETIC BEARING CONTROL PORTION

202 MOTOR DRIVE CONTROL PORTION

203 TEMPERATURE MEASUREMENT PORTION

204 OUTPUT CONTROL PORTION

MAGNETIC BEARING

121 MOTOR

TEMPERATURE SENSOR

TMS OUTPUT DEVICE

FIG. 6

TOUCHDOWN STATE

LEVITATION STOP

LEVITATION START

STATIONARY LEVITATION STATE

SELF-DIAGNOSIS COMPLETION

POWER ON

SELF-DIAGNOSIS

ROTATION IS DETECTED WHILE ROTATION OPERATION IS STOPPED

ROTATION IS NOT DETECTED WHILE ROTATION OPERATION IS STOPPED

ROTATIONAL SPEED IS LESS THAN LOWER LIMIT DURING ROTATION OPERATION

ROTATION OPERATION START

DECELERATION OPERATION

ROTATION OPERATION STOP

ACCELERATION OPERATION

ROTATIONAL SPEED IS LESS THAN OR EQUAL TO UPPER LIMIT DURING

ROTATION OPERATION (WHEN NOT TRANSITIONING TO STATIONARY

LEVITATION STATE OR ACCELERATION OPERATION)

ROTATIONAL SPEED IS GREATER THAN OR EQUAL TO LOWER LIMIT

DURING ROTATION OPERATION

ROTATIONAL SPEED EXCEEDS UPPER LIMIT DURING ROTATION OPERATION

OR ROTATION OPERATION STOP

RATED OPERATION

FIG. 7

TEMPERATURE [° C]

HEATER TEMPERATURE

HEATER OPERATION

COOLING TEMPERATURE

COOLING VALVE OPERATION

TIME (MINUTE)

ON

OFF

OPEN

CLOSE

FIG. 8

TEMPERATURE [°C]

HEATER TEMPERATURE

HEATER OPERATION

COOLING TEMPERATURE

COOLING VALVE OPERATION

TIME (MINUTE)

ON

OFF

OPEN

CLOSE

What is claimed is:

1. A vacuum pump comprising:

an internal device located in a vacuum pump main body; and a controller for controlling the vacuum pump, wherein the controller executes:

controlling an operating state of the internal device;

collecting state information of the vacuum pump main body at a point in time at which the operating state of the internal device is switched; and recording, in a non-volatile memory, the collected state information, wherein the internal device includes at least one of a heater and a cooling valve, when the internal device is the heater:

the state information includes a heater temperature and a heater on/off state, and the time includes time at which the operating state of the heater is switched from an on state to an off state and time at which the operating state of the heater is switched from the off state to the on state, and when the internal device is the cooling valve:

the state information includes a cooling temperature and a cooling valve open/closed state, and the time includes time at which the operating state of the cooling valve is switched from an open state to a closed state and time at which the operating state of the cooling valve is switched from the closed state to the open state.

2. The vacuum pump according to claim 1, wherein the controller executes (a) recording, in a storage region of a predetermined size in the non-volatile memory, the state information and (b) using the storage region as a ring buffer to record the state information.

3. The vacuum pump according to claim 1, wherein the controller executes collecting the state information of the vacuum pump main body at activation of the vacuum pump.

4. The vacuum pump according to claim 1, wherein the controller executes monitoring, from activation of the vacuum pump, whether the operating state of the internal device is switched by and, without periodically collecting the state information of the vacuum pump main body, collecting the state information of the vacuum pump main body at a point in time at which the operating state of the internal device is switched.

5. A controller for controlling an internal device located in a vacuum pump main body, wherein the controller executes:

controlling an operating state of the internal device;

collecting state information of the vacuum pump main body at a point in time at which the operating state of the internal device is switched; and recording, in a non-volatile memory, the collected state information, wherein the internal device includes at least one of a heater and a cooling valve, when the internal device is the heater:

the state information includes a heater temperature and a heater on/off state, and the time includes time at which the operating state of the heater is switched from an on state to an off state and time at which the operating state of the heater is switched from the off state to the on state, and when the internal device is the cooling valve:

the state information includes a cooling temperature and a cooling valve open/closed state, and the time includes time at which the operating state of the cooling valve is switched from an open state to a closed state and time at which the operating state of the cooling valve is switched from the closed state to the open state.

* * * * *